US010357813B2

(12) United States Patent
Arai et al.

(10) Patent No.: US 10,357,813 B2
(45) Date of Patent: Jul. 23, 2019

(54) COPPER ALLOY TUBE WITH EXCELLENT HIGH-TEMPERATURE BRAZEABILITY AND MANUFACTURING METHOD THEREFOR

(71) Applicant: Miyoshi Gokin Kogyo Co., Ltd., Saitama (JP)

(72) Inventors: Masato Arai, Saitama (JP); Yuta Arai, Saitama (JP); Mutsuki Ishijima, Saitama (JP); Hayao Eguchi, Saitama (JP); Yoshihito Ogasawara, Saitama (JP); Genjiro Hagino, Saitama (JP)

(73) Assignee: Miyoshi Gokin Kogyo Co., Ltd., Saitama (JP)

( * ) Notice: Subject to any disclaimer, the term of this patent is extended or adjusted under 35 U.S.C. 154(b) by 0 days.

(21) Appl. No.: 15/571,436

(22) PCT Filed: May 8, 2017

(86) PCT No.: PCT/JP2017/017390
§ 371 (c)(1),
(2) Date: Nov. 2, 2017

(87) PCT Pub. No.: WO2017/195729
PCT Pub. Date: Nov. 16, 2017

(65) Prior Publication Data

US 2018/0304328 A1 Oct. 25, 2018

(30) Foreign Application Priority Data

May 13, 2016 (JP) ..... 2016-097032

(51) Int. Cl.
*C22F 1/08* (2006.01)
*B21C 1/00* (2006.01)
(Continued)

(52) U.S. Cl.
CPC ..... *B21C 23/002* (2013.01); *B21C 1/00* (2013.01); *B21C 23/085* (2013.01); *C22C 9/00* (2013.01); *C22F 1/08* (2013.01); *C22F 1/00* (2013.01)

(58) Field of Classification Search
CPC ..... B21C 1/00; B21C 23/002; C22F 1/08
(Continued)

(56) References Cited

U.S. PATENT DOCUMENTS

2011/0174417 A1 7/2011 Oishi

FOREIGN PATENT DOCUMENTS

CN 1597223 A 3/2005
JP S59193233 A 11/1984
(Continued)

OTHER PUBLICATIONS

Bochniak et al., "Nano Grained Structure in KOBO Extruded Bulk Products", Jan. 1, 2010, pp. 11-17, vol. 10, Publisher: Journal of Nano Research.

(Continued)

*Primary Examiner* — Brian D Walck
(74) *Attorney, Agent, or Firm* — Suzannah K. Sundby, Esq.; Canady + Lortz LLP

(57) ABSTRACT

Provided is a copper alloy tube that is a drawn tube made from a CuCrZr alloy which suppresses the deterioration of mechanical strength and, in particular, the coarsening of crystal grains even in a temperature zone of a solutionizing treatment, and is thus excellent in high-temperature brazeability, as well as the manufacturing method therefor. The manufacturing method comprises a solutionizing step of heating and holding a tubular extrusion material at a solutionizing temperature of 900° C. or greater and then water-quenching the tubular extrusion material; a main process step comprising a set of steps including a drawing process
(Continued)

step of drawing the tubular extrusion material, and an intermediate annealing step of heating at an annealing temperature and then water-quenching the drawn material; and an adjusting process step of further drawing the drawn material and setting average crystal grain sizes in a vertical cross section along an axis as well as a horizontal cross section orthogonal to the axis to 50 μm or less each. The average crystal grain sizes of the vertical cross section and the horizontal cross section are each set to 100 μm or greater and the annealing temperature is set to 900° C. or greater after the solutionizing step, thereby making it possible to make the average crystal grain sizes of the vertical cross section and the horizontal cross section 100 μm or less after the adjusting process step, even if heating is performed at at least 980° C. for 30 minutes followed by air-cooling.

6 Claims, 4 Drawing Sheets

(51) Int. Cl.
*B21C 23/00* (2006.01)
*C22C 9/00* (2006.01)
*B21C 23/08* (2006.01)
*C22F 1/00* (2006.01)

(58) Field of Classification Search
USPC ..... 148/680–685
See application file for complete search history.

(56) References Cited

FOREIGN PATENT DOCUMENTS

| | | | |
|---|---|---|---|
| JP | S6059033 | | 4/1985 |
| JP | 1997-076074 | A | 3/1997 |
| JP | 2005288519 | A | 10/2005 |
| JP | 2009-132965 | A | 6/2009 |
| JP | 2013-100579 | A | 5/2013 |
| KR | 20100060024 | A | 6/2010 |
| WO | 2009119222 | A1 | 10/2009 |

OTHER PUBLICATIONS

Extended European Search report received in EP17796090 dated Oct. 25, 2018.
Tabernig et al., "Improved CuCrZr/316L transition for plasma facing components", Jul. 8, 2007, pp. 1793-1798, vol. 82, No. 15-24, Publisher: Fusion Engineering and Design.
Office Action received in KR1020177034929 dated Feb. 15, 2019.

Fig. 1
unit : mass%
| Cr | Zr | Cu |
|---|---|---|
| 0.5～1.5 | 0.02～0.20 | Bal. |
Fig. 2
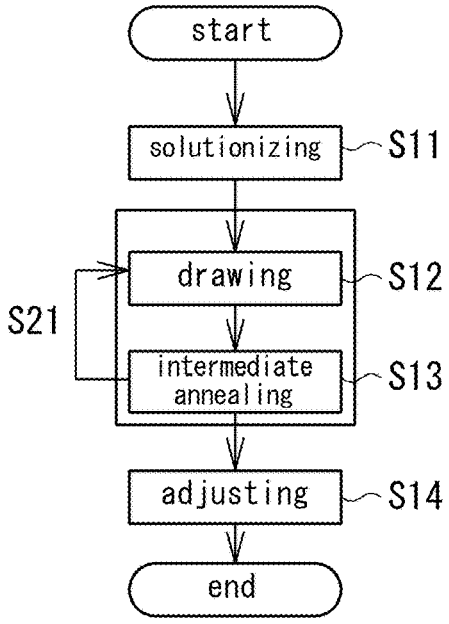
Fig. 3
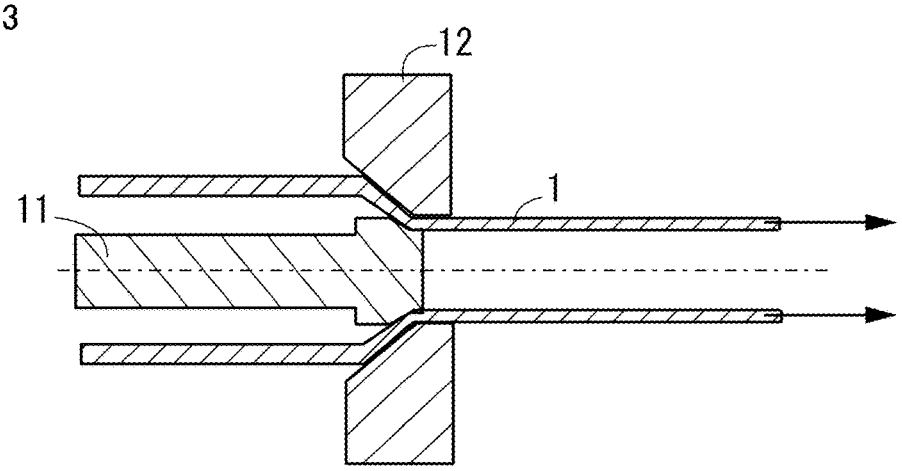

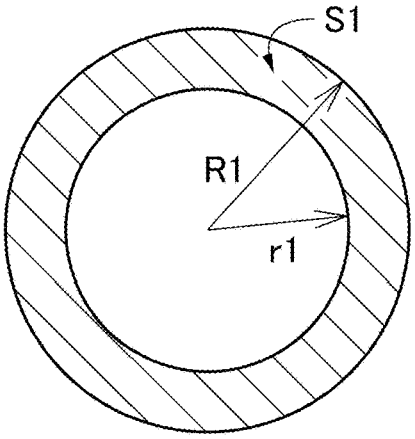
Fig. 4A
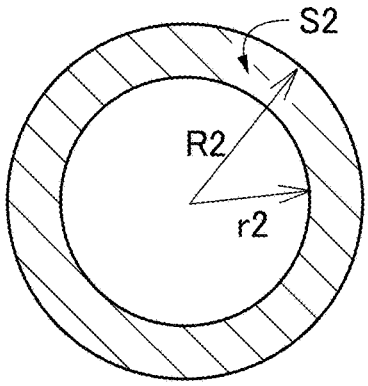
Fig. 4B
Fig. 5
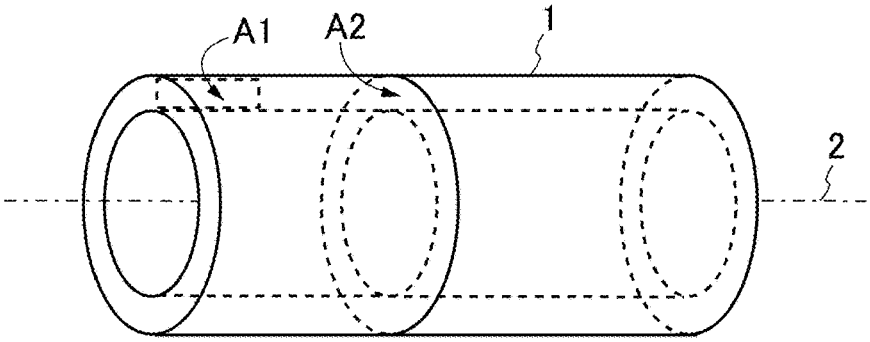
Fig. 6
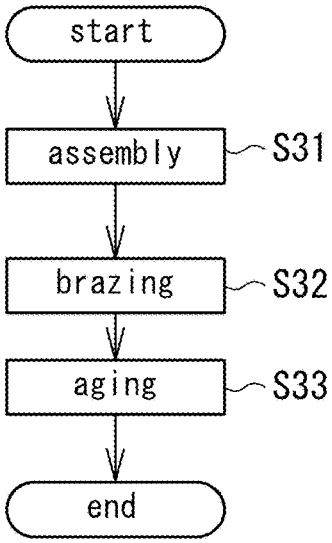

Fig. 7

| | pre-processing | solutionizing | drawing | intermediate annealing | adjusting |
|---|---|---|---|---|---|
| example 1 | 31.7% | 980°C × 30min.wq | 52.4% | 980°C × 30min.wq | 42.0% |
| example 2 | 31.7% | 980°C × 30min.wq | 52.4% | 980°C × 30min.wq | 76.3% |
| example 3 | 31.7% | 980°C × 30min.wq | 52.4% | 980°C × 30min.wq | |
| | | | 56.1% | 900°C × 30min.wq | 46.1% |
| comparative example 1 | 31.7% | 900°C × 30min.wq | 52.4% | 600°C × 30min.wq | 74.9% |

Fig. 8

| | average crystal grain sizes before heat treatment (μm) | | average crystal grain sizes after heat treatment (μm) | |
|---|---|---|---|---|
| | vertical cross section A1 | horizontal cross section A2 | vertical cross section A1 | horizontal cross section A2 |
| example 1 | 29.0 | 16.9 | 86.8 | 71.7 |
| example 2 | 15.7 | 8.0 | 66.0 | 58.4 |
| example 3 | 24.0 | 22.6 | 70.6 | 69.5 |
| comparative example 1 | 16.1 | 7.8 | 227.7 | 58.9～145.9 |

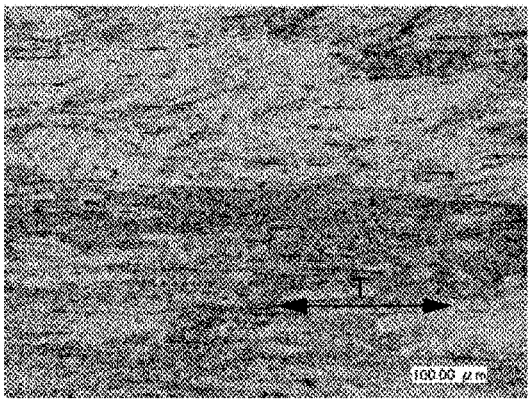

vertical cross section
Fig. 9A

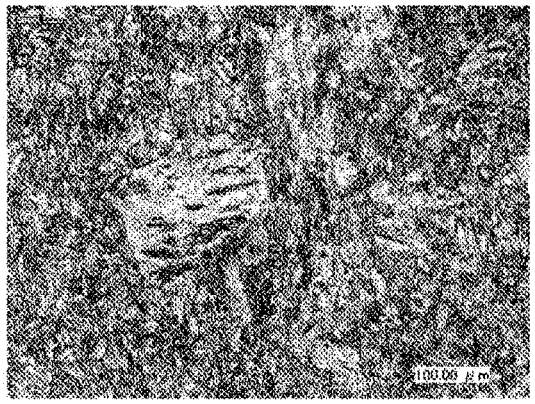

horizontal cross section
Fig. 9B

Fig. 10
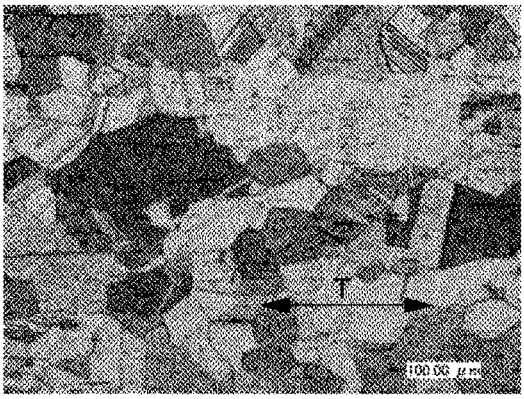
vertical cross section
Fig. 10A
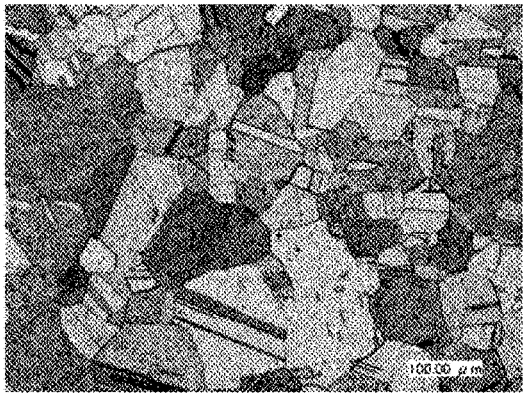
horizontal cross section
Fig. 10B
Fig. 11
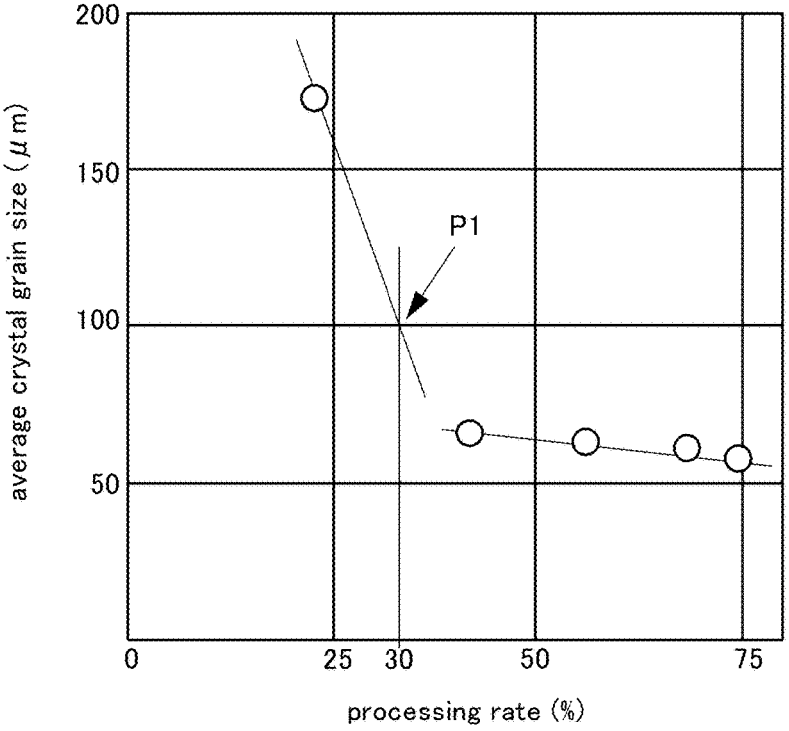

COPPER ALLOY TUBE WITH EXCELLENT HIGH-TEMPERATURE BRAZEABILITY AND MANUFACTURING METHOD THEREFOR

BACKGROUND OF THE INVENTION

Field of the Invention

The present invention relates to a copper alloy tube with excellent high-temperature brazeability and the manufacturing method therefor, and particularly relates to a copper tube made from a chromium-zirconium-copper alloy capable of suppressing the coarsening of crystal grains, even at a high brazing temperature of 900° C. or greater, and which is thus excellent in mechanical properties, and the manufacturing method therefor.

Description of the Background Art

Copper tubes having high thermal conductivity are often used for water-cooling piping and refrigerant piping of a heat exchanger. Various developments have been made in copper alloy tubes made from a copper alloy with an added alloy component, particularly from the viewpoint of resistance to special environments, including heat resistance, pressure resistance, and/or corrosive environment resistance. There is sometimes a need for these tubes to have as one of their properties excellent resistance to deterioration from the brazing required for integration into various devices.

For example, Patent Document 1 discloses a copper alloy tube that is made from a Cu—Co—P based alloy generally excellent in heat resistance, and free of significant loss in mechanical strength even by a brazing treatment at high temperatures of 800° C. or greater, as well as the manufacturing method therefor. First, a Cu—Co—P based alloy billet having an adjusted Co and P component composition is heated to a temperature of 680 to 800° C. to carry out a homogenizing treatment, subsequently hot-extruded at a temperature of 750 to 980° C., and then water-cooled to obtain an extruded tube. This extruded tube is then rolled and reduced to obtain a drawn tube (smooth tube) having a predetermined size, and deposits are dispersed by intermediate annealing in which the drawn tube is held at a temperature of 400 to 700° C. for five minutes to one hour. Furthermore, the drawn tube is then reduced and subjected to final annealing in which the tube is held at a temperature of 500 to 750° C. for about five minutes to one hour to soften the hardened drawn tube and once again disperse deposits. Here, while annealing is performed twice, this annealing is not only for reducing distortion to make drawing easier, but also for dispersing deposits. As a result, deposits such as Co—P compounds, (Co, Ni)—P compounds, and the like can be dispersed so as to act as pinning grains for suppressing the coarsening of crystal grains.

Patent Document 2 and Patent Document 3 describe precipitation-hardening type chromium-zirconium-copper (CuCrZr) alloys that contain about 1 mass % Cr and Zr, with the Patent Document 2 alloy being an electrode material that requires heat resistance, high temperature strength, high electrical conductivity, and high thermal conductivity, and the Patent Document 3 alloy being a spring material and contact material for electric and electronic parts that further require bending workability, fatigue strength resistance, and the like, respectively. Such an alloy is heated and held at a solutionizing temperature of 900° C. or greater, water-quenched to obtain a super-saturated solid solution, formed into a predetermined shape, subjected to an aging treatment at a temperature of about 400 to 500° C., and used upon dispersing and precipitating fine deposits and adjusting the mechanical strength.

PATENT DOCUMENTS

Patent Document 1: Japanese Laid-Open Patent Application No. 2013-100579

Patent Document 2: Japanese Laid-Open Patent Application No. H09-76074

Patent Document 3: Japanese Laid-Open Patent Application No. 2009-132965

SUMMARY OF THE INVENTION

Problems to be Solved by the Invention

In recent years, high energy efficiency has been in demand for power generators and the like, and a great amount of work is being performed at higher temperatures. Under such circumstances, use of a CuCrZr alloy excellent in reliability at high temperatures can be considered for heat exchanger piping and the like. Nevertheless, manufacturing examples of an alloy tube that uses such an alloy are still few and far between.

Further, even in the joining of parts, in a device that requires operation at high temperatures such as described above, it is possible to apply a brazing treatment that uses a brazing material that contains metal having a high melting point, such as nickel, chromium, or tungsten, which exhibits high reliability at high temperatures. However, the temperature of such a brazing treatment may reach 900° C. or greater and, depending on the case, about 1,000° C. That is, the temperature is comparable to the temperature zone of a solutionizing treatment of a general copper alloy, including chromium-zirconium-copper alloy, and as such causes problems, in particular in the deterioration of mechanical strength caused by the coarsening of crystal grains.

The present invention was made in light of circumstances such as described above, and it is therefore an object of the present invention to provide a copper alloy tube that is a drawn tube made from a chromium-zirconium-copper alloy, capable of suppressing the deterioration of mechanical strength and, in particular, the coarsening of crystal grains, even in a temperature zone comparable to that of a solutionizing treatment, and that is thus excellent in high-temperature brazeability, as well as the manufacturing method therefor.

Means for Solving the Problems

In a brazing treatment at a high temperature comparable to the temperature zone of a solutionizing treatment such as described above, a portion of precipitated particles can be dissolved in the parent phase, and thus suppression of the coarsening of crystal grains by such a pinning effect of precipitated particles cannot be expected. Therefore, the inventors of the present invention, while earnestly observing the behavior of recrystallization and the growth of crystal grains at temperatures higher than the general aging temperature of about 450° C. of a precipitation-hardening type alloy, came to discover the present invention. That is, the present invention was achieved upon the discovery that, with at least a CuCrZr alloy, increasing the annealing temperature during the drawing process by a considerable extent greater than the conventional temperature allows introduction of a distortion in the subsequent drawing process, which suppresses the coarsening of crystal grains such as described above.

That is, the method for manufacturing a copper alloy tube with excellent high-temperature brazeability according to the present invention comprises: a solutionizing step of heating and holding a tubular extrusion material, made from a chromium-zirconium-copper alloy having a component composition consisting of 0.5 to 1.5 mass % Cr, 0.02 to 0.20 mass % Zr, and the remaining components being unavoidable impurities and Cu, at a solutionizing temperature of 900° C. or greater and then water-quenching the tubular extrusion material; a main process step comprising a set of steps including a drawing process step of drawing the tubular extrusion material to obtain a drawn material, and an intermediate annealing step of heating at an annealing temperature and then water-quenching the drawn material; and an adjusting process step of further drawing the drawn material and setting average crystal grain sizes in a vertical cross section along an axis as well as a horizontal cross section orthogonal to the axis to 50 micrometers or less each. The average crystal grain sizes of the vertical cross section and the horizontal cross section are each set to 100 micrometers or greater and the annealing temperature is set to 900° C. or greater after the solutionizing step, thereby making the average crystal grain sizes of the vertical cross section and the horizontal cross section 100 micrometers or less after the adjusting process step, even if heating is performed at at least 980° C. for 30 minutes followed by air-cooling.

According to such an invention, the average crystal grain size does not significantly increase even when heating is performed at the temperature zone of a solutionizing treatment of 900° C. or greater during a brazing treatment, making it possible to provide a copper alloy tube capable of suppressing deterioration of mechanical strength.

In the invention described above, in the adjusting process step, the drawing process may be performed at a surface area reduction rate of 40% or greater of the horizontal cross section. Further, in the drawing process step, the drawing process may be performed at a surface area reduction rate of 50% or greater of the horizontal cross section. According to such an invention, an increase in average crystal grain size is reliably suppressed even in a high-temperature brazing treatment, making it possible to provide a copper alloy tube capable of further suppressing deterioration of mechanical strength.

In the invention described above, in the adjusting process step, the drawing process may be performed over a plurality of times. Further, in the drawing process step, the drawing process may be performed over a plurality of times. According to such an invention, the distortion caused by the drawing process can be adjusted, and an increase in average crystal grain size is reliably suppressed even in a high-temperature brazing treatment, making it possible to provide a copper alloy tube capable of further suppressing deterioration of mechanical strength.

Further, in the invention described above, the main process step may include the set of steps a plurality of times. According to such an invention, the distortion caused by the drawing process and the intermediate annealing can be adjusted, and an increase in average crystal grain size is reliably suppressed even in a high-temperature brazing treatment, making it possible to provide a copper alloy tube capable of further suppressing deterioration of mechanical strength.

Further, in the invention described above, in the solutionizing step, the tubular extrusion material may be heated after pre-processing in the drawing process. According to such an invention, it is possible to decrease the processing rate of the main process step and increase manufacturing efficiency.

A copper alloy tube with excellent high-temperature brazeability according to the present invention is made from a chromium-zirconium-copper alloy having a component composition consisting of 0.5 to 1.5 mass % Cr, 0.02 to 0.20 mass % Zr, and the remaining components being unavoidable impurities and Cu. Average crystal grain sizes of a vertical cross section along an axis and a horizontal cross section orthogonal to the axis are each set to 50 micrometers or less, and the average crystal grain sizes of the vertical cross section and the horizontal cross section are each set to 100 micrometers or less, even if heating is performed at at least 980° C. for 30 minutes followed by air-cooling.

According to such an invention, the average crystal grain size does not significantly increase even when heating is performed at the temperature zone of the solutionizing treatment of 900° C. or greater during a brazing treatment, making it possible for this material to be used for a piping of a higher temperature heat exchanger or the like with minimal deterioration of mechanical strength.

BRIEF DESCRIPTION OF THE DRAWINGS

FIG. 1 is a table showing a component composition of a copper alloy used for a copper alloy tube according to the present invention.

FIG. 2 is a flowchart showing a manufacturing method according to the present invention.

FIG. 3 is a cross-sectional view for describing a method of a drawing process.

FIGS. 4A and 4B are cross-sectional views for describing a processing rate.

FIG. 5 is a diagram illustrating cutting directions of observed samples.

FIG. 6 is a flowchart showing a method for installing the copper alloy tube to a device.

FIG. 7 is a table showing processing conditions of examples and a comparative example of the copper alloy tube according to the present invention.

FIG. 8 is a table showing crystal grain sizes of the examples and the comparative example of the copper alloy tube according to the present invention.

FIGS. 9A and 9B are structural images of cross-sectional observations of the copper alloy tube of Example 2.

FIGS. 10A and 10B are structural images of cross-sectional observations of the copper alloy tube of FIGS. 9A and 9B after heat treatment.

FIG. 11 is a graph showing the relationship between processing rate and crystal grain size in an adjusting process step.

DESCRIPTION OF THE PREFERRED EMBODIMENTS

In the following, one example of a method for manufacturing a copper alloy tube according to the present invention will be described using FIGS. 1 to 6.

As shown in FIG. 1, a CuCrZr alloy, which is a precipitation-hardening type copper alloy excellent in electrical conductivity, thermal conductivity, and mechanical properties at high temperatures, is used as the copper alloy for a copper alloy tube. Typically, the copper alloy C18150, containing 0.5 to 1.5 mass % Cr and 0.02 to 0.20 mass % Zr, is used for this tube. Such a copper alloy is generally subjected to a solutionizing treatment at 900° C. or greater, machined into shapes of various electric parts and the like, subsequently subjected to an aging treatment (heat treatment) that disperses a precipitation phase, and then used. Here, on the other hand, the copper alloy is plastic-formed into a copper alloy tube, typically drawn, aged, and then used. It should be noted that, while the brazing treatment onto various devices may follow the aging treatment, high-temperature treatments, particularly brazing treatments in which the metal is exposed to temperatures of 900° C. or greater, which is comparable to the temperature of a solutionizing treatment, are preferably performed prior to the aging treatment. This will be described later.

As illustrated in FIG. 2, a tubular extrusion material made from the CuCrZr alloy described above is heated and held at a solutionizing temperature, and then water-quenched (S11: solutionizing step). This tubular extrusion material is drawn to obtain a drawn material (S12: drawing process step), the drawn material is heated to a temperature higher than the annealing temperature for conventional process-induced distortion removal, such as an annealing temperature of 900° C. or greater, for example, and water-quenched after the distortion is annealed (S13: intermediate annealing step). Subsequently, the drawing process is performed, and the average crystal grain size is adjusted to 50 μm or less (S14: adjusting process step). It should be noted that this set of processing including the drawing process step S12 and the intermediate annealing step S13 is preferably repeated as appropriate (S21).

At least in the case of CuCrZr alloy, the distortion of the drawing process, in which plastic forming is performed with the tubular shape retained as is, is corrected in the intermediate annealing step S13. After the annealing temperature at this time is increased to the high temperature of 900° C. or greater, water-quenching is performed so as to control recrystallization during the temperature drop, allowing the distortion introduced in the adjusting process step S14 to then function so as to suppress the average crystal grain size to 100 μm or less, even under the high-temperature conditions of the subsequent brazing treatment, such as the temperature conditions of heating at 980° C. for 30 minutes and then air-cooling, for example.

Further, this set of processing that includes the drawing process step S12 and the intermediate annealing step S13 is repeated, allowing the distortion introduced in the adjusting process step S14 to function so as to further suppress crystal growth under the high-temperature conditions of the subsequent brazing treatment.

More specifically, in the solutionizing treatment step S11, the tubular extrusion material obtained from an alloy ingot having a component composition such as shown in FIG. 1 is heated to and held at the solutionizing temperature and subsequently water-quenched. Here, while consideration may be given to the heating temperature, heating duration, and the like from the perspective of efficiently homogenizing the tubular extrusion material at a macro level, the internal heat gradient in a copper alloy excellent in thermal conductivity can be reduced, making the copper alloy not largely dependent on shape and the need to consider such factors minimal. It should be noted that when the solutionizing temperature is too high, the component composition may change. Therefore, even in the atmosphere or, more typically, in an inert gas atmosphere or a reducing gas atmosphere (the same for other heating treatment as well, unless otherwise noted), the tubular extrusion material is heated to a solutionizing temperature between 900° C. and 1,050° C., held for about 30 minutes to one hour, and then water-quenched. With the water-quenching, recrystallization during the temperature drop is suppressed and the coarsened crystal grains are cooled as is, thereby unavoidably obtaining an average crystal grain size of 100 μm or greater.

It should be noted that, prior to the solutionizing treatment step S11, performing plastic forming such as a drawing process (pre-processing) on the tubular extrusion material to a predetermined size makes it possible to lower the necessary processing rate resulting from the subsequent drawing process, and is thus preferred in terms of manufacturing efficiency.

The drawing process step S12 is a cold forming step at room temperature and, as illustrated in FIG. 3, is performed using a plug 11 inserted into an alloy tube 1, and a die 12. While the thickness of the alloy tube 1 can be determined by the difference between the die diameter and the plug diameter, preferably the mode of introduction of process distortion is varied over a plurality times to obtain a predetermined diameter size.

Here, as illustrated in FIG. 4, the processing rate γ is expressed by a reduction rate of the cross-sectional area of a horizontal cross section. That is, given $S_1$ (outer diameter $R_1$, inner diameter $r_1$) and $S_2$ (outer diameter $R_2$, inner diameter $r_2$) as the cross-sectional areas before processing and after processing, respectively, then:

$$\text{Processing rate } \gamma=(S_1-S_2)/S_1=\{(R_1^2-r_1^2)-(R_2^2-r_2^2)\}/(R_1^2-r_1^2)$$

The intermediate annealing step S13 is a step in which the tubular extrusion material is heated and held at a predetermined temperature, recrystallization during temperature drop is controlled, and water-quenching is performed. The distortion introduced in the drawing process step S12 is alleviated, and the distortion introduced in the adjusting process step S14 is then introduced so as to suppress the growth of the crystal grains in a subsequent brazing treatment S32 (described later). Thus, the temperature to which the tubular extrusion material is heated and held is 1,050° C. or less, and should be a temperature of at least 800° or greater, preferably 850° C. or greater, and more preferably 900° C.

It should be noted that the set of steps including the drawing process step S12 and the intermediate annealing step S13 may be performed a plurality of times (S21). In this case, the distortion introduced in the adjusting process step S14 can be introduced so as to further suppress the growth of crystal grains in the subsequent brazing treatment S32.

The adjusting process step S14, similar to the drawing process step S12, is a cold forming step that uses the plug 11 and the die 12 (refer to FIG. 3). As illustrated in FIG. 5, in this adjusting process step S14, a drawing process is performed so as to set the average crystal grain sizes in a vertical cross section A1 along an axis 2 of the alloy tube 1 and a horizontal cross section A2 orthogonal to the axis 2 to 50 μm or less each. Here as well, the process may be performed over a plurality of times to obtain a predetermined diameter size. In the drawing process, the process is performed over a plurality of times even when the same processing rate is applied, and thus the mode of introduction of process distortion may become more complex.

With the above, it is possible to obtain a copper alloy tube with excellent high-temperature brazeability prior to the aging treatment.

It should be noted that, as illustrated in FIG. 6, the copper alloy tube obtained via the adjusting process step S14 is installed to a predetermined device that uses the copper alloy tube (assembly step: S31), brazed using a brazing material that contains a metal having a high melting point such as nickel, chromium or tungsten which is highly reliable at high temperatures (brazing treatment step: S32), and lastly heated in its entirety, thereby precipitating deposits and adjusting the mechanical strength (aging treatment step: S33).

As described above, the alloy tube obtained via the adjusting process step S14 can suppress deterioration of mechanical strength without significantly increasing the average crystal grain size, even when heating is performed at the temperature zone of the solutionizing treatment of 900° C. or greater. For example, even if heating is performed at at least 980° C. for 30 minutes followed by air-cooling, the average crystal grain sizes in the vertical cross section A1 and the horizontal cross section A2 can be set to 100 μm or less.

EXAMPLES

As shown in FIG. 7, a copper alloy tube was created by the manufacturing method described above, and the crystal grain size was measured and observed before and after heat treatment modeled on the brazing treatment step S32.

First, a tubular extrusion material was drawn (pre-processed) at a processing rate of γ=31.7% to obtain a tube having an outer diameter of 57 mm and a thickness of 4 mm. The tube was then heated and held at 980° C. for 30 minutes and water-quenched to obtain a tubular material.

In Examples 1 and 2, the material was drawn at a processing rate of γ=52.4% over three times as the drawing process step S12, subsequently heated and held at 980° C. for 30 minutes as the intermediate annealing step S13, and then water-quenched. Subsequently, the material was adjusted at a processing rate of γ=42.0% over two times as the adjusting process step S14 in Example 1, and adjusted at a processing rate of γ=76.3% over six times as the adjusting process step S14 in Example 2.

In Example 3, the material was drawn at a processing rate of γ=52.4% over three times as the drawing process step S12, subsequently heated and held at 980° C. for 30 minutes as a first intermediate annealing step S13, and then water-quenched. Furthermore, the material was drawn at a processing rate of γ=56.1% over three times as the second drawing process step S12, subsequently heated and held at 900° C. for 30 minutes as the intermediate annealing step S13, and then water-quenched. The resulting tube was then adjusted at a processing rate of γ=46.1% over two times as the adjusting process step S14.

On the other hand, in Comparative Example 1, the material was drawn at a processing rate of γ=52.4% over three times as the drawing process step S12, subsequently heated and held at 600° C. for 30 minutes as the intermediate annealing step S13, and then water-quenched. Furthermore, the resulting tube was then adjusted at a processing rate of γ=74.9% over six times as the adjusting process step S14.

Portions of these materials were cut out, the vertical cross section A1 and the horizontal cross section A2 (refer to FIG. 5) were observed under a microscope, and the crystal grain sizes were measured. The remainder was subjected to heat treatment modeled on the brazing treatment step S32, that is, heated and held at 980° C. for 30 minutes and then air-cooled. Then, in the same way, the vertical cross section A1 and the horizontal cross section A2 were observed under a microscope, and the crystal grain sizes were measured. The results are shown in FIG. 8. It should be noted that the crystal grain sizes were measured in accordance with ASTM E 112-96 (2004), and the average crystal grain sizes were indicated.

As shown in FIG. 8, the average crystal grain sizes before heat treatment in Examples 1 to 3 as well as Comparative Example 1 were 50 μm or less. In contrast, after heat treatment, the average crystal grain sizes in Examples 1 to 3 were 100 μm or less and crystal grain growth could be suppressed, while the average crystal grain size in Comparative Example 1, in which the heat treatment in the intermediate annealing step S13 was performed at 600° C., was 100 μm or greater and abnormal grain growth was observed. That is, the observation was made that performing the intermediate annealing step S13 at a higher temperature made it possible to suppress crystal grain growth. It should be noted that, in Example 3, it was confirmed that the average crystal grain size could be maintained at 100 μm or less even under the temperature conditions of heating and holding the tube at 985° C. for three hours and then air-cooling.

FIGS. 9A to 10B show microphotographs of the vertical cross section A1 and the horizontal cross section A2 of Example 2 before and after heat treatment. In FIGS. 9A and 9B, it is clear that the crystal grains became distorted, and distortion intricately accumulated in the interior of the crystal grains as well. On the other hand, in FIGS. 10A and 10B, the sizes of the crystal grains in both the vertical cross section and the horizontal cross section are relatively very uniform, and sub-grains are also clearly observed.

Further, in FIG. 9A, the crystal grains are observed extending in a drawing direction T. On the other hand, FIG. 10A shows that, while the size of the crystal grain is substantially constant, the crystal grains are aligned in the drawing direction T, and these are recrystallized grains resulting from heat treatment. According to the heat treatment at a higher temperature in the intermediate annealing step S13 described above, recrystallization of the crystal grains is prioritized over crystal growth in the brazing treatment step S32, and a relatively fine crystal grain is considered to be obtained.

In Examples 1 and 2, the processing rates of the adjusting process step S14 are different. FIG. 11 shows the processing rate and measurement results of the crystal grain size after heat treatment, along with other measurements. That is, as long as the processing rate of the adjusting process step S14, as indicated by P1 in FIG. 11, is 30% or greater, and preferably 40% or greater, it is possible to suppress the crystal grain size to 100 μm or less.

While the above has described examples according to the present invention and modifications based on these, the present invention is not limited thereto, and those skilled in the art may conceive various alternative examples and modified examples, without departing from the spirit or the appended claims of the present invention.

DESCRIPTIONS OF REFERENCE NUMERALS

1 Tube
2 Axis
11 Plug
12 Die
A1 Vertical cross section
A2 Horizontal cross section

What is claimed is:

1. A method for manufacturing a copper alloy tube, the method comprising:

a solutionizing step of heating and holding a tubular extrusion material, made from a chromium-zirconium-copper alloy having a component composition consisting of 0.5 to 1.5 mass % Cr, 0.02 to 0.20 mass % Zr, impurities, and Cu, at a solutionizing temperature of 900° C. or greater, and then water-quenching the tubular extrusion material, wherein the average crystal grain sizes of the vertical cross section and the horizontal cross section are each set to 100 micrometers or greater; thereafter a main process step comprising a set of steps including a drawing process step of drawing the tubular extrusion material to obtain a drawn material at a surface area reduction rate of 40% or greater of the horizontal cross section, and an intermediate annealing step of heating at an annealing temperature, wherein the annealing temperature is set to 900° C. or greater, and then water-quenching the drawn material; and an adjusting process step of further drawing the drawn material and setting average crystal grain sizes in a vertical cross section along an axis as well as a horizontal cross section orthogonal to the axis to 50 micrometers or less each.

2. The method for manufacturing a copper alloy tube according to claim 1, wherein the drawing process step performs the drawing process at a surface area reduction rate of 50% or greater of the horizontal cross section.

3. The method for manufacturing a copper alloy tube according to claim 2, wherein the adjusting process step performs the drawing process a plurality of times.

4. The method for manufacturing a copper alloy tube according to claim 3, wherein the drawing process step performs the drawing process a plurality of times.

5. The method for manufacturing a copper alloy tube according to claim 4, wherein the main process step performs the set of steps a plurality of times.

6. The method for manufacturing a copper alloy tube according to claim 5, wherein the solutionizing step further includes heating the tubular extrusion material after preprocessing in a drawing process.

* * * * *